US005263828A

United States Patent [19]

Schwing et al.

[11] Patent Number: 5,263,828

[45] Date of Patent: Nov. 23, 1993

[54] TWO-CYLINDER THICK MATTER PUMP HAVING A PISTON STORAGE

[75] Inventors: Friedrich Schwing, Gelsenkirchen; Wolfgang Merten, Witten, both of Fed. Rep. of Germany

[73] Assignee: Friedrich Wilh. Schwing GmbH, Fed. Rep. of Germany

[21] Appl. No.: 982,067

[22] Filed: Nov. 25, 1992

Related U.S. Application Data

[63] Continuation of Ser. No. 692,783, Apr. 26, 1991, abandoned, which is a continuation of Ser. No. 501,653, Mar. 29, 1990, abandoned.

[30] Foreign Application Priority Data

Mar. 29, 1989 [DE] Fed. Rep. of Germany ..... 3910189

[51] Int. Cl.[5] ..... F04B 17/00

[52] U.S. Cl. ..... 417/403; 417/540; 417/900

[58] Field of Search ..... 417/401, 403, 540, 900; 91/50

[56] References Cited

U.S. PATENT DOCUMENTS

| | | | |
|---|---|---|---|
| 3,663,129 | 5/1972 | Antosh | 417/900 |
| 3,963,385 | 6/1976 | Caban | 417/900 |
| 4,611,973 | 9/1986 | Birdwell | 417/401 |

FOREIGN PATENT DOCUMENTS

| | | |
|---|---|---|
| 234514 | 11/1963 | Austria . |
| 2119865 | 3/1983 | European Pat. Off. . |
| 55-87867 | 7/1980 | Japan . |

*Primary Examiner*—Richard A. Bertsch
*Assistant Examiner*—Charles G. Freay
*Attorney, Agent, or Firm*—Kinney & Lange

[57] ABSTRACT

The invention relates to a two-cylinder thick matter pump having a piston storage which is filled during the thick matter feed with the feed cylinders and evacuated by the hydrocontrolled storage piston into the feed pipe between the strokes of the feed pistons to reduce the pressure drop and the undelivered amount in the feed pipe. The inventive proposal is that the hydrocontrol of the storage piston (10) is served by a working piston (8) to be acted upon hydraulically on both sides, that is controlled with the feed cylinders and whose limits of travel, with the limits of travel of the storage piston (10), are fixed on the storage driving cylinder (7) when the storage cylinder (4) is fully evacuated and is filled.

14 Claims, 2 Drawing Sheets

TWO-CYLINDER THICK MATTER PUMP HAVING A PISTON STORAGE

This is a continuation of application Ser. No. 07/692,783 filed on Apr. 26, 1991, which is a continuation of application Ser. No. 07/501,653 filed on Mar. 29, 1990, both of which are abandoned as of the date of this application.

BACKGROUND OF THE INVENTION

The present invention relates to a two-cylinder thick matter pump having a piston storage.

With its piston storage the inventive two-cylinder thick matter pump compensates pressure and volume fluctuations in the feed pipe that arise between the strokes of the cooperating feed cylinders. These fluctuations, that disturb the uniformity factor of the feed, are, for constructional reasons, larger in the case of mechanically controlled feed cylinders, e.g. feed cylinders whose pistons are driven with a crankshaft, than in the case of hydraulically driven feed pistons, which allow the piston strokes to be covered but cannot prevent pressure and volume fluctuations in the feed pipe, either, when the piston of the feeding cylinder is switched over to the suction stroke and the piston of the feed cylinder sucking out of the prefilling vessel of the pump is switched over to the pressure stroke. In this switch-over phase the piston storage presses thick matter into the feed pipe, thereby at least partly compensating the pressure and volume loss of the switch-over phase.

The inventive two-cylinder thick matter pumps thus differ from piston pumps which aim to improve the uniformity factor of the thick matter feed with at least three or even more feed cylinders, because with such pump constructions thick matter must be sucked out of the prefilling vessel with the second or additional feed cylinders, while with the piston storages the additional feed volume passes from the feed pipe into the storage and from there back into the feed pipe during the switch-over phase of the feed cylinders. Thick matter pumps having more than two feed cylinders to compensate volume and pressure fluctuations in order to increase the uniformity factor in the feed pipe can reduce the pressure fluctuations at the expense of a simple mechanical construction and simple control means, with a considerable increase in technical effort, but they cannot avoid speed droops in the feed.

The invention relates in particular to thick matter pumps which feed sludge. This may be turbid coal slime for acting upon furnaces with fossil fuels, sewage sludge, mortar and plaster compounds or the like, but particularly media which tend to solidify in the rest phase of their feed and thus cake on the walls of feed paths that at times conduct no feed stream. Such media are above all hydraulically setting media and sludges with pozzolanic properties. It is often important to feed such substances at a high uniformity factor because pressure and volume fluctuations in following installations, e.g. in furnaces, cause difficulties or led to considerable dynamic stresses, which is the case in particular with high lifts.

To compensate such fluctuations the invention employs a piston storage. Piston storages generally use a cylinder built onto the feed pipe and opening into it on one side while its other end is closed by a movable piston. Such piston storages differ from bubble storages by the piston, and from air domes by the fact that the pumping medium is closed off in the storage by a firm but movable wall. Piston storages permit virtually any feed pressure and can therefore be used together with pumps that reach considerable lifts.

The invention starts with a known thick matter pump that works with a piston storage. The storage piston works with its side facing away from the pumping medium on a pressure cushion consisting of a high-pressure gas. During the pressure stroke of the feed cylinders the storage cylinder fills up with pumping medium from the feed pipe, whereby the storage piston compresses the gas cushion. As soon as the pressure collapses, or drops, in the feed pipe in the switch-over phase, the high-pressure gas cushion urges the piston in the opposite direction and presses pumping medium out of the storage cylinder into the feed pipe. Such a piston storage can in fact improve the uniformity factors of thick matter feed.

However, the disadvantage is that a complete evacuation of the storage cylinder is not ensured. This has various causes, but the consequence is that pumping medium tending to cake or harden prematurely impairs the storage relatively quickly and eventually blocks it. This not only reduces the uniformity factor of the feed but also results in disturbances in the feed which are relatively difficult to eliminate.

SUMMARY OF THE INVENTION

The invention is based on the problem of improving the uniformity factor of feed in a two-cylinder thick matter pump having the general construction described at the outset, said improvement functioning perfectly even with a pumping medium that tends to harden prematurely or cake on parts of the feed pipe.

Since the storage piston is driven by a hydraulic working cylinder according to the invention, one can dispense with a gas cushion that loads the storage piston, replacing it by the working piston directly connected therewith, whose forced control with the feed cylinders of the thick matter pump ensures that the storage piston is returned in the storage cylinder for the storage to be filled, in the pumping phase, and presses the storage content in the opposite direction into the feed pipe, in the switch-over phase. The limits of travel of the working piston are hydraulically fixed and therefore also determine the limits of travel of the storage piston, whose outer extreme position in the storage cylinder is selected in such a way that the storage is completely evacuated. Since these limits of travel are forced in each switch-over phase, the pumping medium contained in the storage can at no time solidify and block the storage.

The hydraulic medium required for supplying energy to the storage driving cylinder can come from the pressure generator of the thick matter pump whose feed cylinders are directly driven by hydraulic working cylinders. This considerably simplifies the storage operation, which requires no external source of pressure gas. The forced control of the working piston also eliminates the irregularities in the storage piston position which come about in particular when the lifting times of the feed cylinders are variable, which is the case in many thick matter pumps for regulating the delivery.

One embodiment of the invention ensures by hydraulic means that the storage cylinder is briefly evacuated in accordance with the duration of the switch-over phase, and also makes its possible to fill the storage cylinder in the pumping phase following the switch-over phase in such a way that the pumping medium penetrating into the storage cylinder does not cause a pressure drop in the feed pipe, which is effected by accordingly prolonging the time of filling of the storage up to a maximum time, that may correspond to the pumping phase but is selectable in individual cases. One thus obtains a virtually complete uniformity of the feed stream. The brief evacuation of the storage is effected with the aid of the high-pressure hydraulic working medium of the storage drive, while the longer duration of the storage filling is effected by regulating the stream into the working piston ring space, in which the hydraulic pressure acts in the same direction as the pressure of the pumping medium on the storage piston and returns the working piston. The storage piston return time can be regulated by adjusting the stream into the storage driving piston ring space.

One embodiment of the invention permits control of the hydraulic pressure on the piston side in the hydraulic working cylinder, and thus a fixing of the evacuation time of the storage cylinder. The hydraulic accumulator provided for this purpose also allows for compensation of wrong amount of the hydraulic working medium for the storage operation.

The above-described regulation of the filling time of the storage cylinder is made possible hydraulically in a simple way by manual adjustment, which offers the advantage that the thick matter pump can be adapted at any time to the conditions of a specific case of application, in particular to changing preconditions which may be created by the particular pumping medium.

In an alternative embodiment, however, an automatic adjustment of the flow control valve allows for the storage filling to be adapted to changing evacuation times of the feed cylinders, which occur particularly when the thick matter pump is adjusted to different deliveries.

BRIEF DESCRIPTION OF THE DRAWINGS

The invention shall be explained in more detail in the following with reference to an exemplary embodiment that is shown in the connection diagrams, of which

DETAILED DESCRIPTION OF THE PREFERRED EMBODIMENTS

Figure 1:
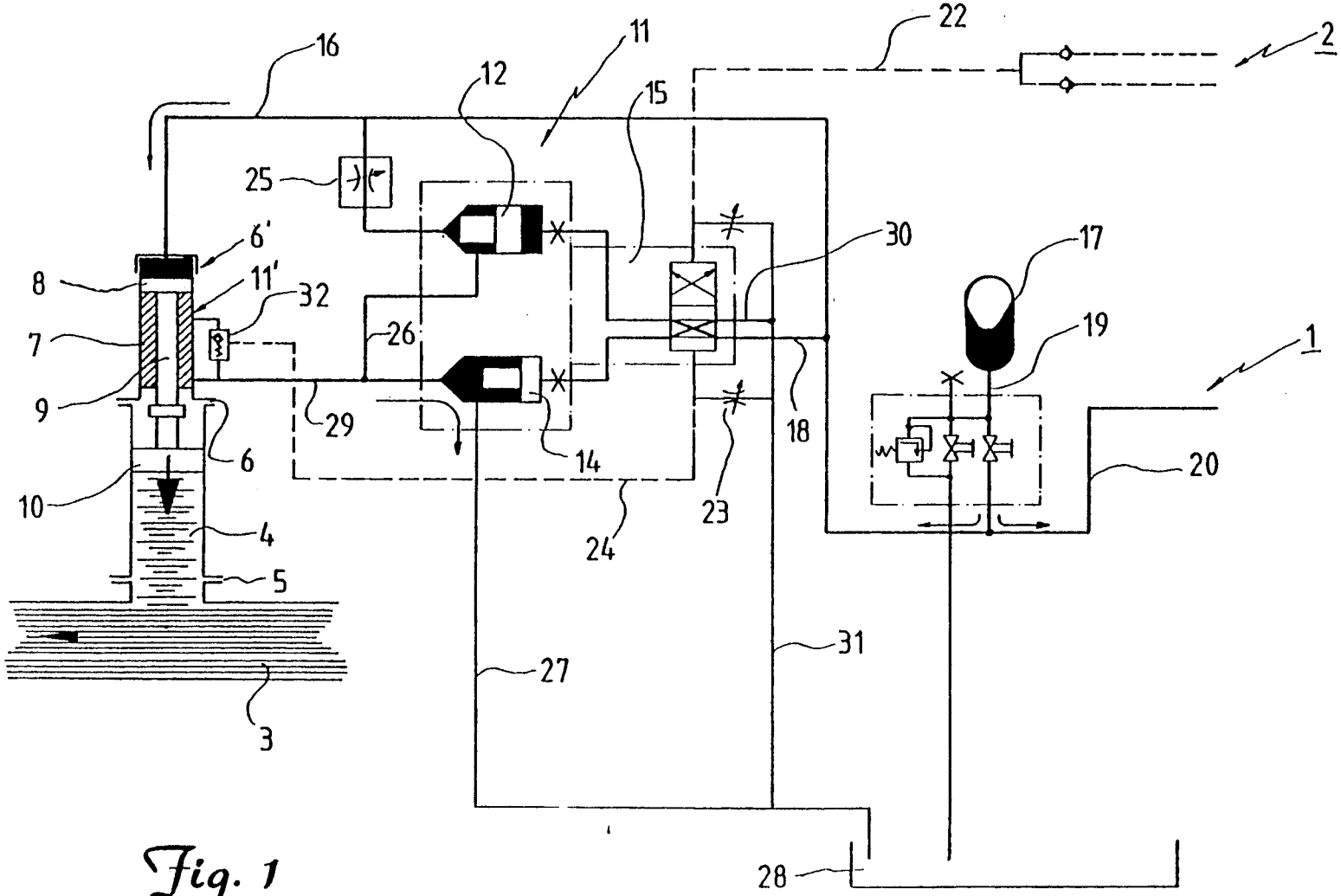
FIG. 1 shows schematically, i.e., free from all details that are unnecessary for understanding the invention, the connection state during evacuation of the piston storage into the feed pipe during the switch-over phase of the feed cylinders.

The connection to the hydraulic pressure generator of the hydraulically driven feed cylinders of the thick matter pump is shown at 1. Switch signals are present at 2 for the limits of travel of the pistons in the feed cylinders or in hydraulic driving cylinders of the thick matter pump.

The feed cylinders of the thick matter pump (not shown) work alternatingly on a feed pipe 3, one of the feed cylinders sucking the thick matter out of a prefilling vessel of the pump, while the other feed cylinder presses its previously sucked in filling into feed pipe 3. Directly following the port of the feed cylinders, e.g. on the upper side of a bifurcated pipe that combines the feed of the two feed cylinders, a storage cylinder 4 is flange-mounted at 5. The opposite end of storage cylinder 4 is flange-mounted on a working cylinder 7 whose working piston 8 drives a storage piston 10 mounted on its piston rod 9 and closing storage cylinder 4 against flange 6.

Two seat valves 12 and 14 control hydraulic working cylinder 7 and are indicated within the dot-dash line at 11. Seat valves 12 and 14 are piloted by a 2/2 directional valve 15. Piston space 6' closed by the full piston area of working piston 8 is connected directly to a hydraulic accumulator 17 by a line 16 bypassing 2/2 directional valve 15. Line 16 feeds the 2/2 directional valve 15 via a branch 18. Line 19 to hydraulic accumulator 17 opens into line 16 before directional valve 15. Connection 20 to the line coming from the pressure generator is located before line 19.

The 2/2 directional valve 15 is switched over with the aid of a hydraulic control line 22. The switch-over takes place against the pressure from a line 24 which is relieved from the tank 28 via a choker 23.

In the switch-over phase shown in FIG. 1, the 2/2 directional valve 15 is changed over via line 22, so that hydraulic working medium reaches seat valve 12 via line 18 to block the hydraulic connection to piston ring space 11' of working cylinder 7 closed by the full piston of working piston 8. At the same time, seat valve 14 is relieved from the tank on its back via lines 30, 31, so that it unblocks the path via line 27 to tank 28. Bypassing the 2/2 directional valve 15, high-pressure hydraulic working medium thus passes from hydraulic accumulator 17 to piston side 6' of the working piston 8, so that storage piston 10 presses the volume of pumping medium contained in storage cylinder 4 into feed pipe 3.

An on-off valve 32 in working cylinder 7, which is controlled hydraulically by piston 8, controls the limit of travel of working piston 8 in cylinder 7. The switch point is selected in such a way that the total volume of storage cylinder 4 is pressed into feed pipe 3. The piston ring side of working cylinder 7 is depressurized via line 27. This makes it possible to transfer the storage content into feed pipe 3 while overcoming the feed pipe pressure.

Figure 2:
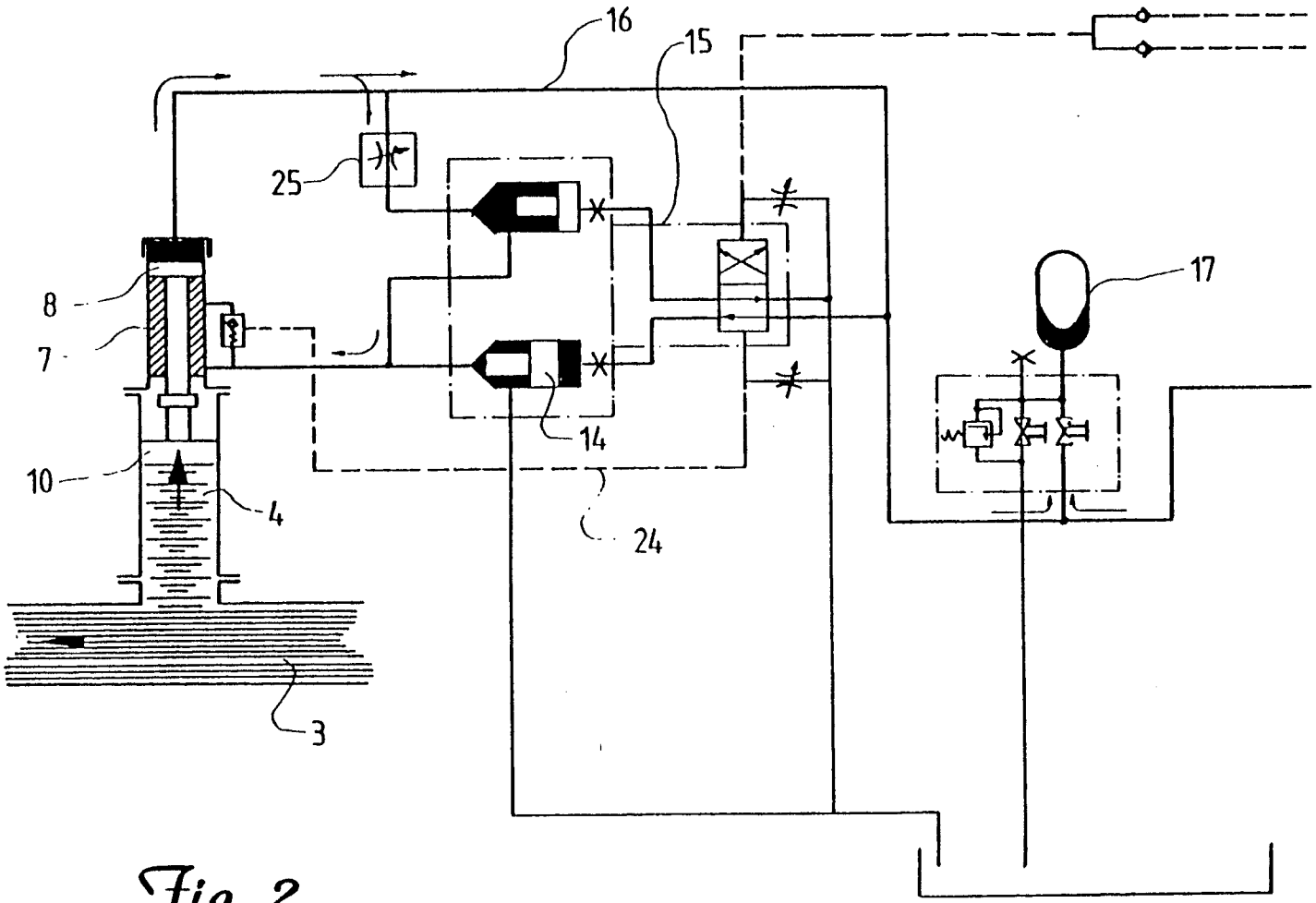
FIG. 2 shows the connection state during the filling of the piston storage out of the feed pipe in the pumping phase of the feed cylinders.

As soon as working piston 8 has fully evacuated storage cylinder 4, the switch signal of valve 32 triggered thereby switches over the 2/2 directional valve 15. In the following pumping phase (FIG. 2), in which seat valve 14 is closed via the storage pressure and seat valve 12 is opened by the storage pressure, the hydraulic working pressure is applied to both sides of working piston 8. The hydraulic working medium pressure built up in ring space 11' acts in the same direction on working piston 8 in cylinder 7 as the feed pipe pressure on storage piston 10 in storage cylinder 4. This moves working piston 8 in the opposite direction, pressing hydraulic working medium via line 16 bypassing 2/2 directional valve 15 into hydraulic accumulator 17, which is fed from hydraulic pressure generator 1. This allows storage cylinder 4 to be filled with medium from feed pipe 3 for compensation in the following switch-over phase. Flow control valve 25 is used to adjust the return time of storage piston 10 to make it correspond to the duration of the feed stroke of the thick matter pump, in order to prevent a change in delivery due to the filling of the storage.

The return time of working piston 8 for filling storage 4 can be adjusted by hand by adjusting flow control valve 25. However, this adjustment can also be performed automatically in order to adapt the return time of the storage piston 10 to changing lifting times of the thick matter pump.

Instead of changing over the 2/2 directional valve 15 hydraulically, one can also do this electrically via limit switches.

We claim:

1. A two-cylinder thick matter pump having a feed pipe through which thick matter is delivered, and having a storage cylinder with a movable storage piston connected to the feed pipe which is filled during each pumping stroke of the pump and is evacuated by movement of the storage piston between the pumping stroke to reduce pressure drop and undelivered amounts of thick matter in the feed pipe, characterized in that movement of the storage piston is controlled by a double-acting hydraulic drive working cylinder having a working piston which is acted upon hydraulically on both sides so that the working piston is driven hydraulically in a first direction to a first end position at a first rate during each pumping stroke which causes the storage piston to move in the storage cylinder to a first limit position which allows the storage cylinder to fill with thick matter from the feed pipe to a maximum volume, and so that the working piston is driven hydraulically in a second opposite direction from the first end position to a second end position at a second, higher rate between the pumping strokes which causes the storage piston to move in the storage cylinder from a first limit position to a second limit position in which the storage cylinder is fully evacuated; and in that the working piston in the double acting hydraulic drive working cylinder is acted upon hydraulically on both sides to control the end position of the working piston and the limit position of the storage piston by a hydraulic control means that includes:

two seat valves hydraulically connected to the working cylinder which enable hydraulic fluid to fill a piston ring space located on a first side of the working piston and to exit a piston space located on a second side of the working piston during each pumping stroke and which enable the hydraulic fluid to exit the piston ring space and fill the piston space between each pumping stroke;

a directional valve hydraulically connected to the seat valves which hydraulically controls the seat valves by causing hydraulic pressure to alternately open and close each seat valve; and an on/off valve hydraulically connected between the seat valves and the working cylinder and connected to the directional valve, wherein the on/off valve is hydraulically controlled by the working piston and controls the directional valve to hydraulically fix the first and second end positions of the working piston and to also hydraulically fix the first and second limit positions of the storage piston.

2. The two-cylinder thick matter pump of claim 1 characterized in that the first rate of movement of the working piston is regulated by adjusting an applied hydraulic pressure on the working piston to cause the storage piston in the storage cylinder to reach the first limit position at an end of each pumping stroke.

3. The two-cylinder thick matter pump of claim 1 characterized in that a hydraulic accumulator is connected through a hydraulic line to the double-acting hydraulic drive working cylinder to discharge hydraulic fluid between the pumping strokes and to accumulate hydraulic fluid during each pumping stroke.

4. A two-cylinder thick matter pump having a feed pipe through which thick matter is delivered, and having a storage cylinder with a movable storage piston connected to the feed pipe which is filled during each pumping stroke of the pump and is evacuated by movement of the storage piston between the pumping stroke to reduce pressure drop and undelivered amounts of thick matter in the feed pipe, characterized in that movement of the storage piston is controlled by a double-acting hydraulic drive working cylinder having a working piston which is acted upon hydraulically on both sides so that the working piston is driven hydraulically in a first direction to a first end position at a first rate during each pumping stroke which causes the storage piston to move in the storage cylinder to a first limit position which allows the storage cylinder to fill with thick matter from the feed pipe to a maximum volume, and so that the working piston is driven hydraulically in a second opposite direction from the first end position to a second end position at a second, higher rate between the pumping strokes which causes the storage piston to move in the storage cylinder from a first limit position to a second limit position in which the storage cylinder is fully evacuated; in that the first rate of movement of the working piston is regulated by adjusting an applied hydraulic pressure on the working piston to cause the storage piston in the storage cylinder to reach the first limit position at an end of each pumping stroke; and in that a flow control valve serving to adjust the first rate of movement of the working piston is adjustable by hand to cause the storage piston in the storage cylinder to reach the first limit position.

5. A two-cylinder thick matter pump having a feed pipe through which thick matter is delivered, and having a storage cylinder with a movable storage piston connected to the feed pipe which is filled during each pumping stroke of the pump and is evacuated by movement of the storage piston between the pumping stroke to reduce pressure drop and undelivered amounts of thick matter in the feed pipe, characterized in that movement of the storage piston is controlled by a double-acting hydraulic drive working cylinder having a working piston which is acted upon hydraulically on both sides so that the working piston is driven hydraulically in a first direction to a first end position at a first rate during each pumping stroke which causes the storage piston to move in the storage cylinder to a first limit position which allows the storage cylinder to fill with thick matter from the feed pipe to a maximum volume, and so that the working piston is driven hydraulically in a second opposite direction from the first end position to a second end position at a second, higher rate between the pumping strokes which causes the storage piston to move in the storage cylinder from a first limit position to a second limit position in which the storage cylinder is fully evacuated; in that the first rate of movement of the working piston is regulated by adjusting an applied hydraulic pressure on the working piston to cause the storage piston in the storage cylinder to reach the first limit position at an end of each pumping stroke; and in that a flow control valve serving to adjust the first rate of movement of the working piston is automatically adjustable in accordance with the piston speed of the pump to cause the storage piston in the storage cylinder to reach the first limit position.

6. In a two-cylinder thick matter pump having a feed pipe through which thick matter is delivered, an improvement comprising:

a storage cylinder connected to the feed pipe;

a storage piston movable within the storage cylinder;

a double-acting hydraulic drive working cylinder having a working piston which is connected to the storage piston so that movement of the working piston causes movement of the storage piston; and hydraulic control means for applying hydraulic pressure to a first side of the working piston during each pumping stroke of the two-cylinder thick matter pump to cause the working piston to move at a first rate to a first end position which causes the storage piston to move to a first limit position which allows the storage cylinder to fill with thick matter from the feed pipe to a maximum volume, and for applying hydraulic pressure to a second side of the working piston between pumping strokes to cause the working piston to move at a second, higher rate to a second end position which causes the storage piston to move to a second limit position in which the thick matter is fully evacuated from the storage cylinder into the feed pipe, the hydraulic control means comprising:

two seat valves hydraulically connected to the working cylinder which enable hydraulic fluid to fill a piston ring space located on a first side of the working piston and to exit a piston space located on a second side of the working piston during each pumping stroke and which enable the hydraulic fluid to exit the piston ring space and fill the piston space between each pumping stroke;

a directional valve hydraulically connected to the seat valves which hydraulically controls the seat valves by causing hydraulic pressure to alternately open and close each seat valve; and an on/off valve hydraulically connected between the seat valves and the working cylinder and connected to the directional valve, wherein the on/off valve is hydraulically controlled by the working piston and controls the directional valve to hydraulically fix the first and second end positions of the working piston and to also hydraulically fix the first and second limit positions of the storage piston.

7. A two-cylinder thick matter pump having a feed pipe through which thick matter is delivered, and having a storage cylinder with a movable storage piston connected to the feed pipe which is filled during each pumping stroke of the pump and is evacuated by movement of the storage piston between the pumping stroke to reduce pressure drop and undelivered amounts of thick matter in the feed pipe, characterized in that movement of the storage piston is controlled by a double-acting hydraulic drive working cylinder having a working piston which is acted upon hydraulically on both sides so that the working piston is driven in a first direction to a first end position during each pumping stroke which causes the storage piston to move in the storage cylinder to a first limit position which allows the storage cylinder to fill with thick matter from the feed pipe to a maximum volume, and so that the working piston is driven in a second opposite direction from the first end position to a second end position between the pumping strokes which causes the storage piston to move in the storage cylinder from a first limit position to a second limit position in which the storage cylinder is fully evacuated; and wherein the working piston in the double acting hydraulic drive working cylinder is acted upon hydraulically on both sides to control the end position of the working piston and the limit position of the storage piston by a hydraulic control means that includes:

two seat valves hydraulically connected to the working cylinder which enable hydraulic fluid to fill a piston ring space located on a first side of the working piston and to exit a piston space located on a second side of the working piston during each pumping stroke and which enable the hydraulic fluid to exit the piston ring space and fill the piston space between each pumping stroke;

a directional valve hydraulically connected to the seat valves which hydraulically controls the seat valve by causing hydraulic pressure to alternately open and close each seat valve; and an on/off valve hydraulically connected between the seat valves and the working cylinder and connected to the directional valve, wherein the on/off valve is hydraulically controlled by the working piston and controls the directional valve to hydraulically fix the first and second end positions of the working piston and to also hydraulically fix the first and second limit positions of the storage piston.

8. The two-cylinder thick matter pump of claim 7 characterized in that a return time of the working piston is regulated by adjusting an applied hydraulic pressure on the working piston to cause the storage piston in the storage cylinder to reach the first limit position at an end of each pumping stroke.

9. The two-cylinder thick matter pump of claim 8 characterized in that a flow control valve serving to adjust the return time of the working piston is adjustable by hand to cause the storage piston in the storage cylinder to reach the first limit position.

10. The two-cylinder thick matter pump of claim 8 characterized in that a flow control valve serving to adjust the return time of the working piston is automatically adjustable in accordance with the piston speed of the pump to cause the storage piston in the storage cylinder to reach the first limit position.

11. The two-cylinder thick matter pump of claim 7 characterized in that a hydraulic accumulator is connected through a hydraulic line to the double-acting hydraulic drive working cylinder to discharge hydraulic fluid between the pumping strokes and to accumulate hydraulic fluid during each pumping stroke.

12. In a two-cylinder thick matter pump having a feed pipe through which thick matter is delivered, an improvement comprising:

a storage cylinder connected to the feed pipe;

a storage piston movable within the storage cylinder;

a double-acting hydraulic drive working cylinder having a working piston which is connected to the storage piston so that movement of the working piston causes movement of the storage piston; and hydraulic control means for applying hydraulic pressure to a first side of the working piston during each pumping stroke of the two-cylinder thick matter pump to cause the working piston to move to a first end position which causes the storage piston to move to a first limit position which allows the storage cylinder to fill with thick matter from the feed pipe to a maximum volume, and for applying hydraulic pressure to a second side of the working piston between pumping strokes to cause the working piston to move to a second end position which causes the storage piston to move to a second limit position in which the thick matter is fully evacuated from the storage cylinder into the feed pipe; the hydraulic control means including a hydraulic accumulator connected to the hydraulic drive working cylinder on the second side of the working piston, the hydraulic accumulator discharging hydraulic fluid between pumping strokes and accumulating hydraulic fluid during each pumping stroke, wherein hydraulic pressure in the hydraulic accumulator exceeds pressure in the feed pipe during all phases of operation of the pump.

13. A two-cylinder thick matter pump having a feed pipe through which thick matter is delivered, and having a storage cylinder with a movable storage piston connected to the feed pipe which is filled during each pumping stroke of the pump and is evacuated by movement of the storage piston between the pumping stroke to reduce pressure drop and undelivered amounts of thick matter in the feed pipe, characterized in that movement of the storage piston is controlled by a double-acting hydraulic drive working cylinder having a working piston which is acted upon hydraulically on both sides so that the working piston is driven in a first direction to a first end position during each pumping stroke which causes the storage piston to move in the storage cylinder to a first limit position which allows the storage cylinder to fill with thick matter from the feed pipe to a maximum volume, and so that the working piston is driven in a second opposite direction from the first end position to a second end position between the pumping strokes which causes the storage piston to move in the storage cylinder from a first limit position to a second limit position in which the storage cylinder is fully evacuated; and further including a hydraulic accumulator connected through a hydraulic line to the double-acting hydraulic drive cylinder to discharge hydraulic fluid between the pumping strokes to cause movement of the working piston in the second direction, and to accumulate hydraulic fluid during each pumping stroke, wherein hydraulic pressure in the hydraulic accumulator exceeds pressure in the feed pipe during all phases of operation of the pump.

14. The two-cyulinder thick matter pump of claim 13 characterized in that the working piston in the double acting hydraulic drive working cylinder is acted upon hydraulically on both sides to control the end position of the working piston and the limit position of the storage piston by a hydraulic control means that includes:

two seat valves hydraulically connected to the working cylinder which enable hydraulic fluid to fill a piston ring space located on a first side of the working piston and to exit a piston space located on a second side of the working piston during each pumping stroke and which enable the hydraulic fluid to exit the piston ring space and fill the piston space between each pumping stroke;

a directional valve hydraulically connected to the seat valves which hydraulically controls the seat valve by causing hydraulic pressure to alternately open and close each seat valve; and an on/off valve hydraulically connected between the seat valves and the working cylinder and connected to the directional valve, wherein the on/off valve is hydraulically controlled by the working piston and controls the directional valve to hydraulically fix the first and second end positions of the working piston and to also hydraulically fix the first and second limit positions of the storage piston.

* * * * *

UNITED STATES PATENT AND TRADEMARK OFFICE

CERTIFICATE OF CORRECTION

PATENT NO. : 5,263,828

DATED : November 23, 1993

INVENTOR(S) : FRIEDRICH SCHWING, WOLFGANG MERTEN

It is certified that error appears in the above-identified patent and that said Letters Patent is hereby corrected as shown below:

Col. 10, line 7, delete "cyulinder", insert --cylinder--

Signed and Sealed this

Seventeenth Day of May, 1994

*Attest:*

Bruce Lehman

BRUCE LEHMAN

*Attesting Officer*

*Commissioner of Patents and Trademarks*